US006425271B1

(12) United States Patent
Viñas

(10) Patent No.: US 6,425,271 B1
(45) Date of Patent: Jul. 30, 2002

(54) APPARATUS FOR TREATING FABRICS

(75) Inventor: Jaime Anglada Viñas, Matadepera (ES)

(73) Assignee: Jaume Anglada Viñas S.A. (ES)

( * ) Notice: Subject to any disclaimer, the term of this patent is extended or adjusted under 35 U.S.C. 154(b) by 0 days.

(21) Appl. No.: 09/569,252

(22) Filed: May 11, 2000

(30) Foreign Application Priority Data

May 20, 1999 (ES) ..... 9901081

(51) Int. Cl.[7] ..... D06B 3/32

(52) U.S. Cl. ..... 68/177; 34/636; 34/643; 34/651; 68/180

(58) Field of Search ..... 68/62, 177, 178, 68/180, 181 R; 34/636, 643, 651

(56) References Cited

U.S. PATENT DOCUMENTS 2,969,664 A * 1/1961 Nasu et al. ..... 68/178
3,172,275 A * 3/1965 Sando et al. ..... 68/178 X
5,309,613 A 5/1994 Strahm
5,623,738 A * 4/1997 Biancalani et al. ..... 68/178 X

FOREIGN PATENT DOCUMENTS

EP 0 653 508 A2 5/1995
EP 0 787 963 A2 8/1997

* cited by examiner

*Primary Examiner*—Philip Coe
(74) *Attorney, Agent, or Firm*—McGlew and Tuttle, P.C.

(57) ABSTRACT

The invention discloses an apparatus for treating fabrics which comprises a first chamber for forming a reserve of infeed fabric, a second chamber for forming a reserve of outfeed fabric, first means for slowly infeeding the fabric into the first chamber, second means for slowly removing the fabric from the second chamber, a duct allowing for the passage therethrough of the fabric between the first chamber and the second chamber, fabric transport means capable of forward and backward operation which generates a forward and backward movement of the fabric between both chambers, and control means, operation of which causes inversion of the forward and backward movement, and collision members adapted to be impacted by the fabric, which move between a collision position and a free passage position in synchronism with the forward and backward movement of the fabric.

31 Claims, 8 Drawing Sheets

APPARATUS FOR TREATING FABRICS

FIELD OF THE INVENTION

The invention relates to an apparatus for treating fabrics, of the type comprising a first chamber for forming a reserve of infeed fabric, a second chamber for forming a reserve of outfeed fabric, first means for slowly infeeding the fabric into the first chamber, second means for slowly removing the fabric from the second chamber, a duct allowing for the passage therethrough of the fabric between the first chamber and the second chamber, fabric transport means capable of forward and backward operation including nozzles and which is adapted to generate a forward and backward movement of the fabric between the first chamber and the second chamber, and control means, operation of which causes inversion of the forward and backward movement.

PRIOR ART

Such apparatus are already known. For example, EP-0 653 508 discloses an apparatus for the wet treatment of fabrics having two chambers, slow fabric infeed and delivery means and transport means which move the fabric accumulated in the chambers forward and backward from one of the chambers to the other, thereby allowing the fabric to be more rapidly and effectively treated, and without deterioration thereof due to friction. Such treatments may form a very wide range and there may even be diverse groups of modules each formed by a pair of chambers, such that various treatments may be carried out in series. Similar apparatus are also known for the dry treatment of fabrics.

It is frequently of interest that the fabric be subjected to blows during the treatment, so that it may acquire enhanced softness and handle qualities. Apparatus of the type first mentioned above are known which include a striking device. Thus, for example, EP-0 787 963 discloses an apparatus for the dry treatment of fabrics in which there is to be observed, apart from the two chambers, the fabric infeed and delivery means and the fabric transport means, a striking device comprising a rotor with which the fabric collides during the forward and backward movement thereof.

Nevertheless, these apparatus have drawbacks when it is necessary to work at high speeds, i.e., with very high transport fluid flows and/or fabrics of low specific weight. In these cases, the striking device is less effective, and may even in certain cases cause the fabric to wind around the striking device. It is likewise desirable to intensify the striking effect to increase the performance of the apparatus and allow the treatment times to be shortened.

SUMMARY OF THE INVENTION

It is an object of the invention to overcome these drawbacks. This objective is achieved by a fabric treatment apparatus of the type first mentioned above, characterized in that it is provided with at least one collision member adapted to be impacted upon by the fabric, the collision members defining collision surfaces, in that the collision members are adapted to move between a collision position and a free passage position, and in that the movement between the collision position and the free passage position takes place synchronized with the forward and backward movement of the fabric.

In fact, the collision members allow the fabric to undergo a plurality of collisions in each of the directions of forward and backward movement. Furthermore, since the collision members may move between the collision position and the free passage position, the apparatus may be designed in such a way that said collision members are in the collision position when the fabric is moving in one of the directions of the forward and backward movement, while the collision members move to the free passage position when the fabric changes direction, whereby they do not hinder or interfere in the passage of the fabric. This allows the geometry and the position of the collision members to be designed with greater liberty, such that the effect of the blows is optimized.

The apparatus is preferably provided with at least two collision member groups, in such a way that in each direction of the forward and backward movement, at least one of the collision member groups is in the collision position. In this way, the fabric is subjected to the effect of blows in each direction of forward and backward movement, whereby the speed of treatment is doubled relative to the case wherein there are only provided collision members which move into the collision position in one direction of the forward and backward movement.

It is particularly advantageous that the collision members be permeable, or at least partly permeable, to the transport fluid, since, otherwise, the transport fluid is excessively diverted from its original path, causing additional turbulence which makes the transport capacity of the transport fluid less effective and entrains the fabric with it, whereby the effectiveness of the collision of the fabric on the collision members is lowered.

The collision members are preferably formed by substantially rectangular flaps, having at one side a shaft about which they may pivot, so as to pass from the collision position to the free passage position and vice versa. The flap thus forms a wall which is interposed in the path that the fabric would follow in the absence of the collision members, whereby the fabric will collide against the surface of the wall facing the direction of movement of the fabric and which forms the collision surface. There are various ways in which these walls may be formed. They may, for example, be formed by a number of preferably co-planar rods and/or tubes having one end attached to the shaft and the opposite end free. The free ends may optionally be joined together with another rod. Said wall may also be formed by a, for example, metal sheet which may optionally be provided with orifices, allowing for an enhancement of the passage of the transport fluid. The collision surface is generally flat. Nevertheless, it is preferable that in certain cases, said collision surface should not be flat, but should be concave or convex in the direction of incidence of the fabric. An apparatus for the treatment of fabrics according to the invention may have all the collision members identical, or may mount a plurality of mutually different collision members. Furthermore, it is also advantageous for the collision position of the collision members to be adjustable, and it is particularly advantageous that such adjustment may be carried out individually. This adjustment may be desirable both at the start of a treatment, depending on the treatment to be performed and the fabric to be treated, and during the treatment itself.

These collision members are preferably arranged along a duct connecting both chambers. It has been found that it is advantageous to have two additional, also adjustable, collision members, one at each end of the duct connecting both chambers. These additional collision members, apart from the collision function, also have the function of enhancing the piling of the fabric in the corresponding chamber. It is not necessary for these additional collision members to be subjected to movement between the collision position and the free passage position undergone by the remaining collision members, since they are practically outside the path of the fabric, when the latter travels in the opposite direction to the collision direction against the additional collision member, whereby the fabric does not touch the additional collision member and, therefore, it is not necessary for the additional collision member to move to a free passage position, as the remaining collision members do.

The transport means are usually housed at an intermediate point, usually in the mid-point, of the duct connecting both chambers. In certain cases, for example when the duct has an inverted U shape, the transport means are divided into two transport units, each responsible for one direction of movement and between both transport groups, there is a portion of the duct curved in 180 degrees. The fabric, in its forward or backward movement from one chamber to the other, defines a direction of feed or direction of movement, which is also forward or backward. The collision means is preferably arranged on both sides of the transport means, and preferably only those collision members which are downstream of the transport means in the direction of feed of the fabric are in the collision position.

These apparatus are adapted for both dry and wet treatment of fabrics. Likewise, although they are preferably adapted for the treatment of open width fabrics, it is also possible to use apparatus according to the invention for the treatment of fabrics in rope form.

The second means is usually situated in the upper part of the apparatus, approximately above the second chamber. The second means thus removes the fabric from the top of the apparatus, thereby causing the formation of a web of fabric from the bottom of the chamber, where the fabric is alternately accumulated, due to the forward and backward movement, to the top of the apparatus, where it exits the apparatus through the second removal means. In certain cases, the weight of the fabric web may affect the fabric, stretching it for example in the longitudinal direction of the web and contracting it in the transverse direction perpendicular to the web. To avoid these drawbacks, it is preferable to provide the apparatus with removal means having sloping conveyor belts which run from a low point, situated close to the bottom of the second chamber, to a high point and entrain the web of fabric which is resting on the conveyor belt. In this way, the fabric is moved to the top, without being subjected to tensile stress.

The collision members may be driven in different ways. They may, for example, be driven by hydraulic rams. All the collision members may preferably be operated by a single hydraulic ram and a number of levers which transmit the movement to all the collision members. Other drive systems are also possible, such as for example gear trains which may be directly meshed together or which may be associated together with transmission chains. A preferred solution contemplates the possibility of the collision members having individualized drive mechanisms.

BRIEF DESCRIPTION OF THE DRAWINGS

Further advantages and features of the invention will be appreciated from the following description, in which there is related, without any limiting nature, a preferred embodiment of the invention, with reference to the accompanying drawings, in which.

DETAILED DESCRIPTION OF THE INVENTION

Figure 1:
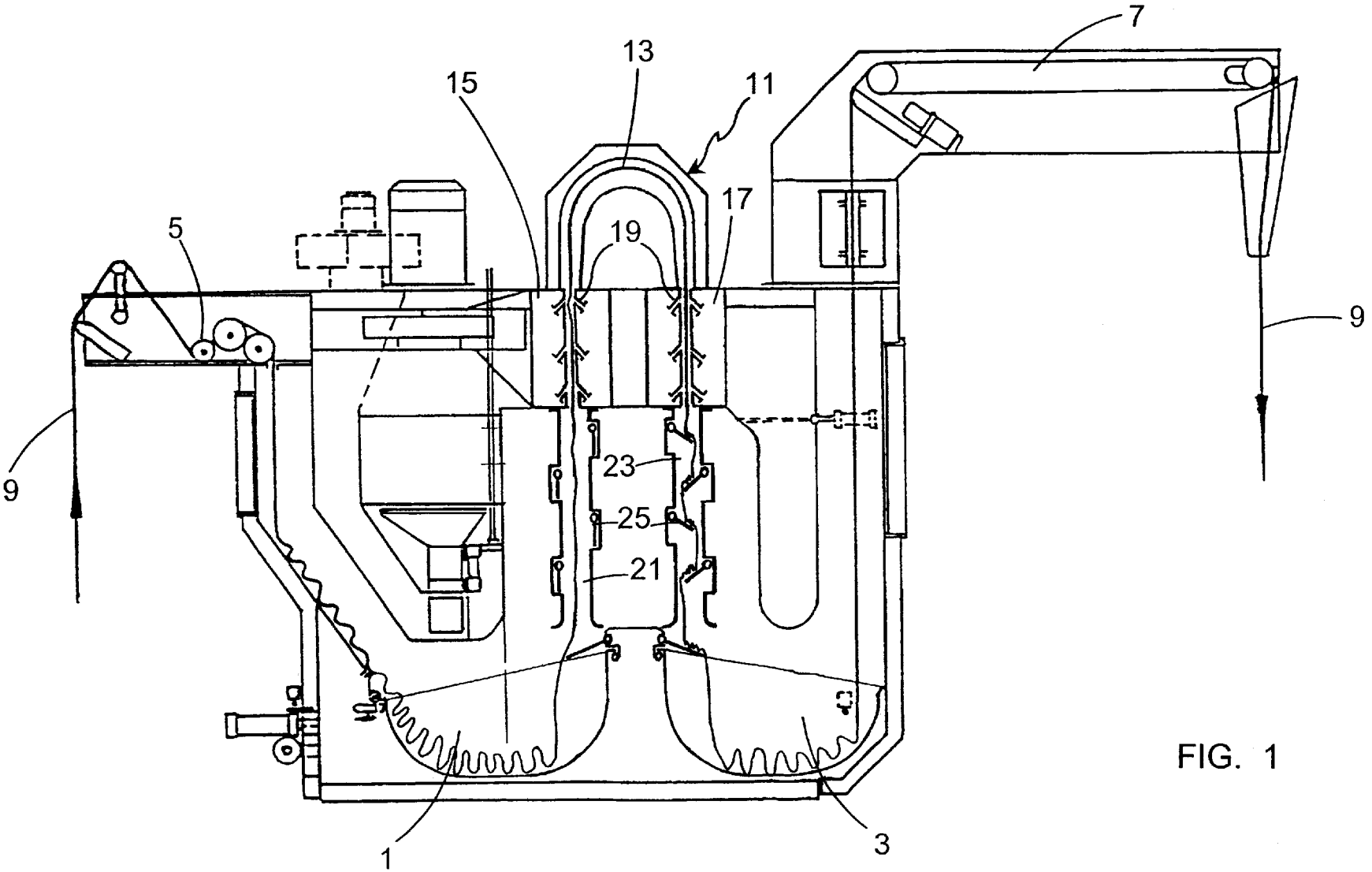
FIG. 1 is a cross section view of an apparatus for the dry treatment of fabrics according to the invention.
Figure 2:
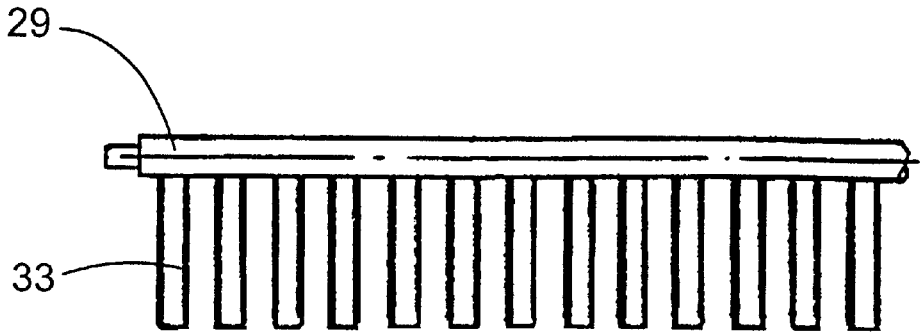
FIGS. 2 to 6 incl., are plan view of five alternative collision members.
Figure 3:
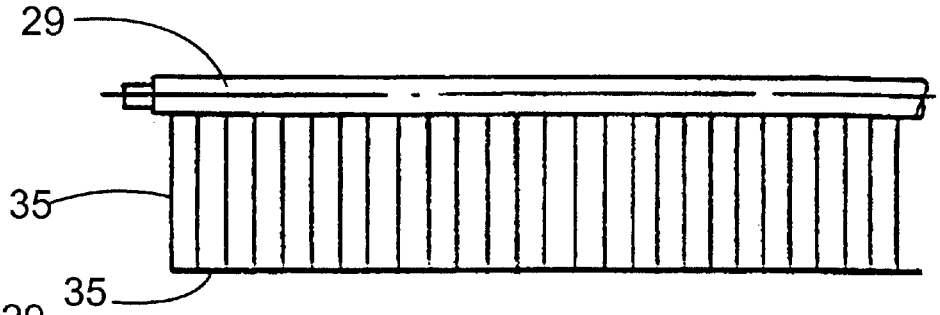
Figure 4:
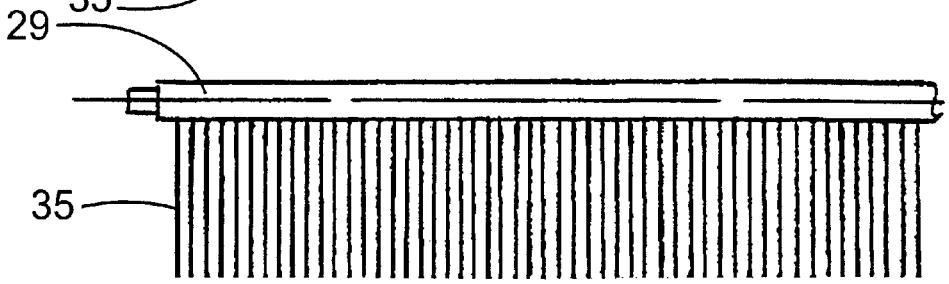
Figure 5:
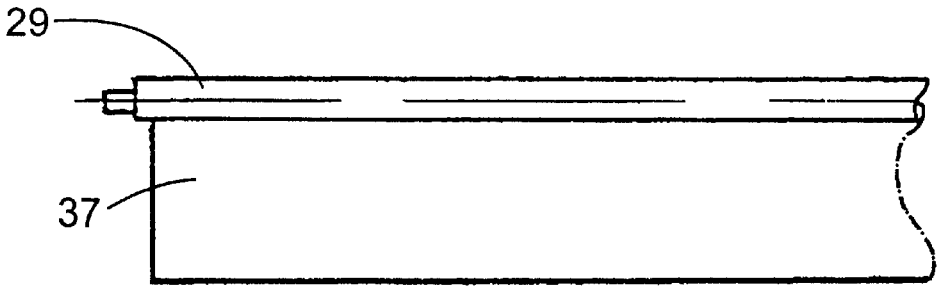
Figure 6:
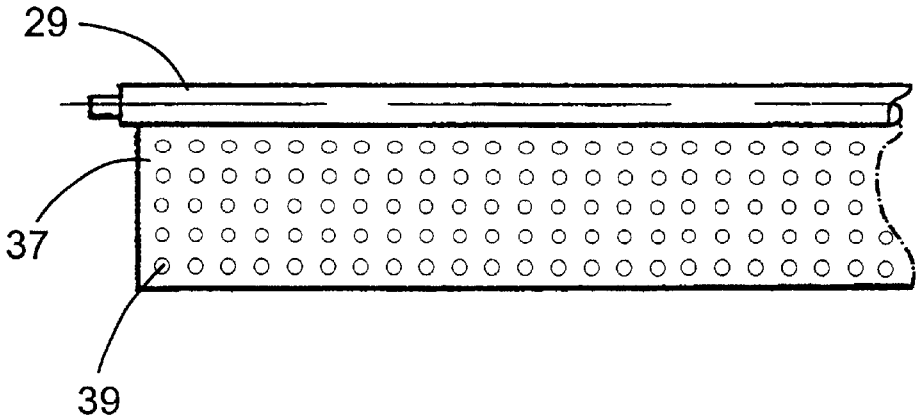

FIG. 1 shows an apparatus for the dry treatment of fabrics according to the invention. The apparatus is provided with a first chamber 1 and a second chamber 3. First means 5 feeds a web or strip of fabric 9 at a slow speed into the first chamber 1, and second means 7 slowly removes the fabric 9 from the second chamber 3. The first chamber 1 and the second chamber 3 are in communication over a duct 11. The duct 11 comprises a center section 13, a first transport section 15 and a second transport section 17, each being provided with transport means 19 and a first collision section 21 and a second collision section 23, each being provided with collision members 25. The center section 13 forms a 180° curve. The duct 11 is thus formed by the following series of sections: first collision section 21, first transport section 15, center section 13, second transport section 17 and second collision section 23.

The transport means 19 includes nozzles through which air is blown at high speed, entraining therewith the fabric 9. The nozzles of the first transport section 15 are directed differently from the nozzles of the second transport section 17, such that the nozzles of one section transport the fabric 9 in the opposite direction to the nozzles of the other section. In this way, depending on the group of nozzles which at any given time is in operation, it is possible to cause the fabric 9 to move forwards and backwards which moves the fabric 9 accumulated in the apparatus to one chamber or the other, 1 or 3. Control means controls the forward and backward movement of the fabric 9 and synchronizes the transport means 19 with the remaining elements.

Figure 7:
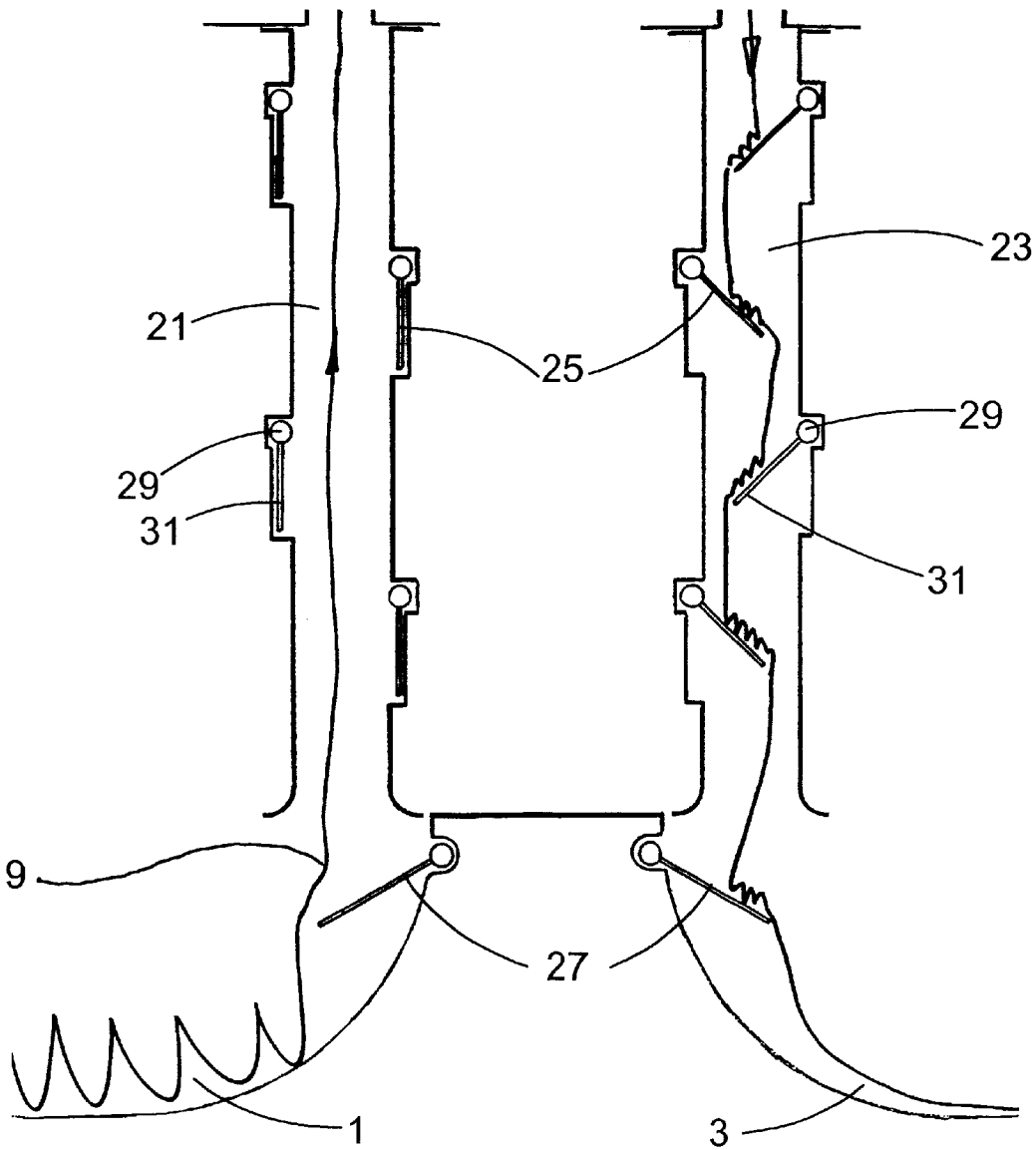
FIG. 7 is an enlarged view of part of the cross section of FIG. 1.

When the fabric 9 is passing from the first chamber 1 to the second chamber 3, which situation is to be observed in FIGS. 1 and 7, the collision members 25 of the first collision section 21 are in the free passage position, thereby allowing free passage of the fabric 9, while the collision members 25 of the second collision section 23 are in the collision position, so that the fabric 9 collides against the collision members 25.

At each end of the duct 11, there is an additional collision member 27.

The collision members 25 may be formed in different ways. FIGS. 2 to 6 incl. show examples of collision members 25 which are formed by a shaft 29, around which the collision member 25 may pivot and a substantially rectangular wall 31, extending lengthwise along the shaft 29, i.e., the shaft 29 is one of the sides of the wall 31. The wall 31 forms a collision surface on which the fabric 9 collides. The wall 31 may be formed in different ways, for example by tubes 33 or rods 35, which are co-planar and have one end attached to the shaft 29 and the other end free, or attached to another rod 35. Where the walls 31 are formed by a sheet 37, the sheet 37 may have orifices 39 which improve the permeability of the wall 31 to the transport fluid.

Figure 8:
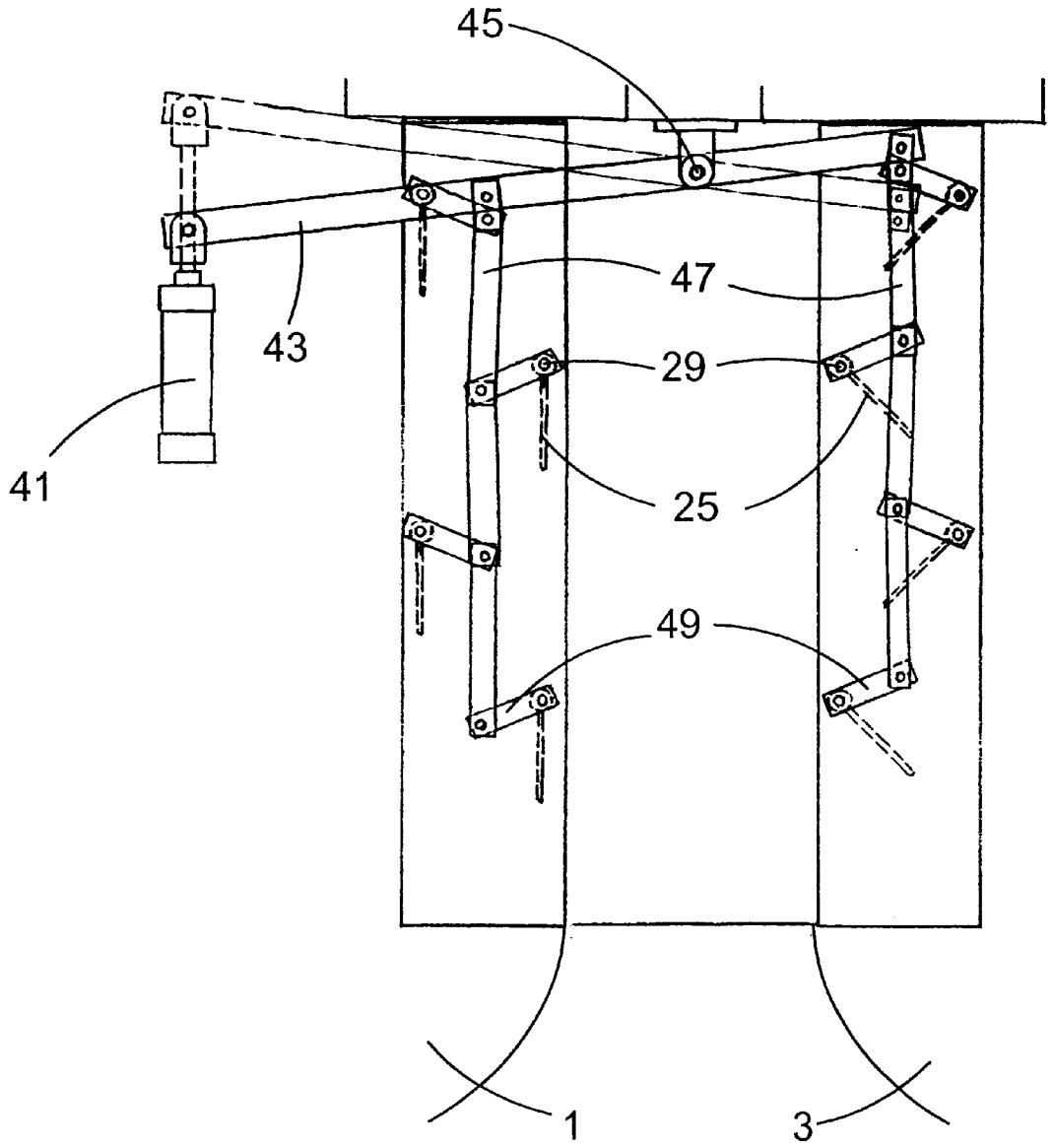
FIG. 8 is an elevation view of a first drive system for collision members.

FIG. 8 shows a drive system for the collision members 25. The system comprises a hydraulic ram 41 and a set of mutually associated levers. One main lever 43 has one end attached to the piston rod of the hydraulic ram 41 and is attached at an intermediate point to a fixed point 45 of the apparatus, about which it may pivot. By this pivoting movement, the main lever 43 pulls the transmission levers 47 towards an upward or downward vertical movement, which levers in turn move drive levers 49. These drive levers 49 have one end attached to the transmission levers 47 in such a way that they accompany them in the upward or downward vertical movement thereof and have the other end attached to the shaft 29 of the collision members 25, with which they may rotate integrally, in such a way that the translation movement of the transmission levers 47 is converted into a rotary movement, suitable for moving the collision members 25 from the collision position to the free passage position, and vice versa.

Figure 9:
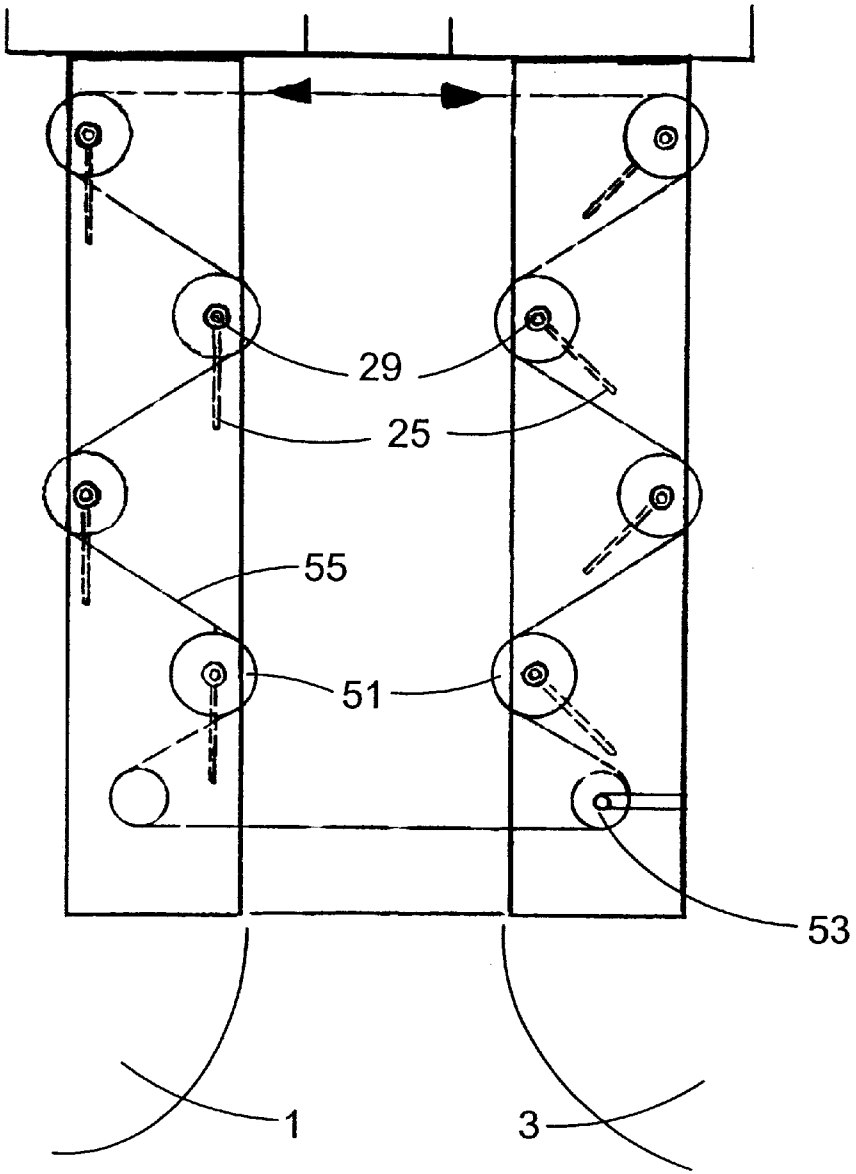
FIG. 9 is an elevation view of a second drive system for collision members.

FIG. 9 shows another drive system for the collision members 25. In this case, each shaft 29 of each collision member 25 has a gear 51 attached fixedly thereto. Additionally, the apparatus has a drive gear 53, which is controlled by any appropriate means, not shown in the drawing, as may be, for example, an electric motor or a hydraulic ram. All the gears 51 are connected together and to the drive gear 53 by a transmission chain 55, as shown in FIG. 9. In this way, when the drive gear 53 rotates, the movement is transmitted by the transmission chain 55 to all the gears 51 which cause the respective shafts 29 to rotate and, therewith, the collision members 25, to the desired position. The transmission chain 55 may optionally by replaced with a transmission gear train, not shown in the drawing.

Figure 10:
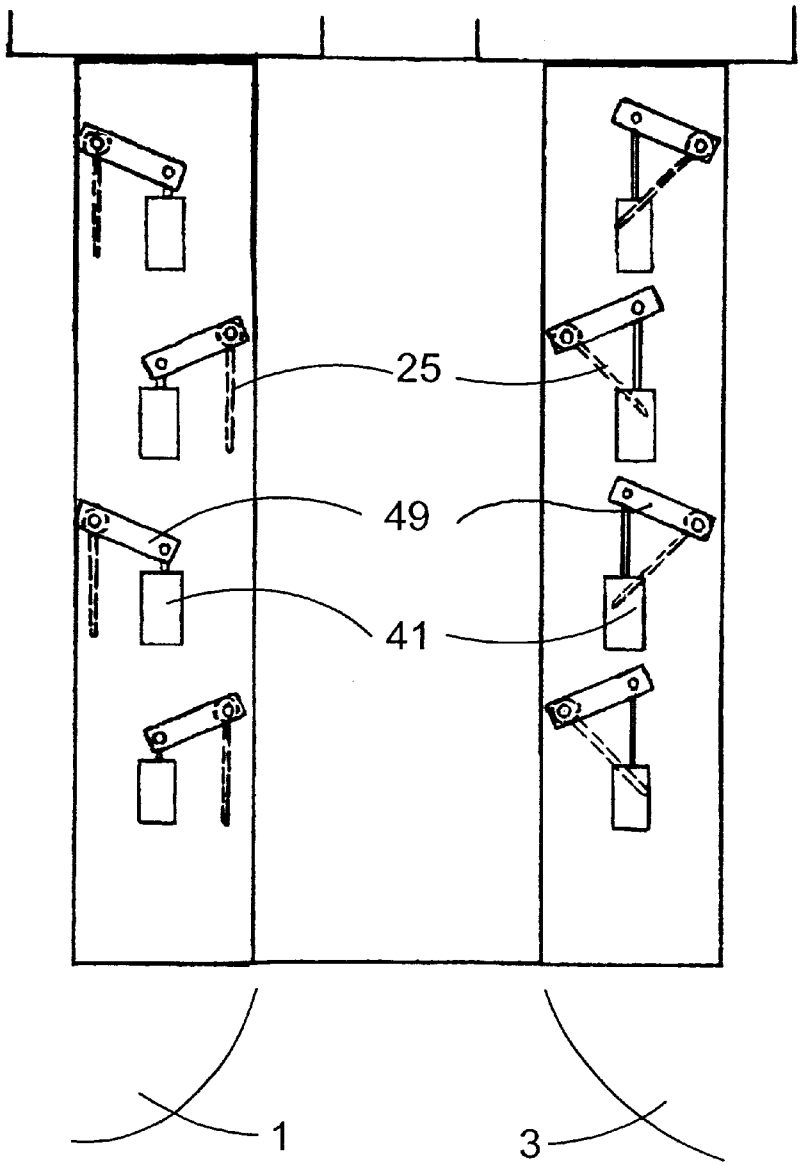
FIG. 10 is an elevation view of a third drive system for collision members.

FIG. 10 shows a drive system for the collision members 25 which allows for independent operation of the different collision members 25. In fact, each collision member 25 is connected to a hydraulic ram 41 through a drive lever 49 which may move the collision member 25 to the desired position, independently of the remaining collision members 25.

Figure 11:
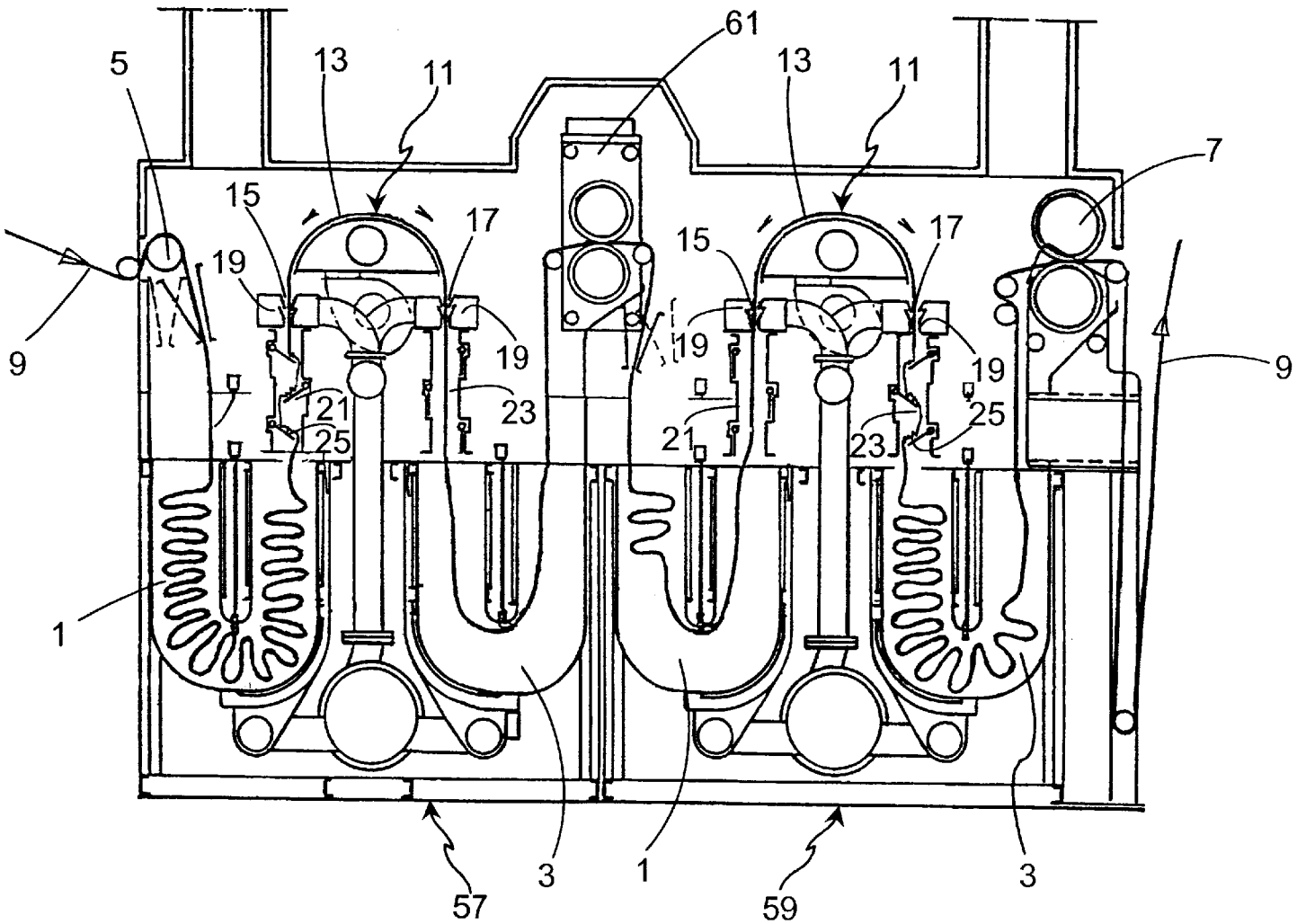
FIG. 11 is a cross section view of an apparatus for the wet treatment of fabrics according to the invention.

The fabric treatment apparatus of FIG. 11 is an apparatus for the wet treatment of fabrics which is provided with two blocks or modules 57 and 59 appropriate for carrying out the forward and backward movement of the fabric 9, and connected in series over transfer means 61 which transfers the fabric slowly from the first module 57 to the second module 59. Each module 57 or 59 shows conceptually the same elements proper to the invention as the apparatus for the dry treatment of fabrics: a first chamber 1 (with its corresponding first slow fabric infeed means 5 or transfer means 61), a second chamber 3 (with its corresponding second slow fabric removal means 7 or transfer means 61), a duct 11 (with a center section 13, a first and a second transport sections 15 and 17, and a first and a second collision sections 21 and 23), transport means 19 and collision members 25. In the instant reflected in FIG. 11, the fabric 9 is passing, in the first module 57, from the second chamber 3 to the first chamber 1, whereby the collision members 25 of the first collision section 21 are in the collision position and the collision members 25 of the second collision section 23 are in the free passage position, while in the second module 59 the fabric 9 is passing from the first chamber 1 to the second chamber 3, whereby the collision members 25 which are in the collision position are those of the second collision section 23 and the collision members 25 of the first collision section 21 are in the free passage position.

Figure 12:
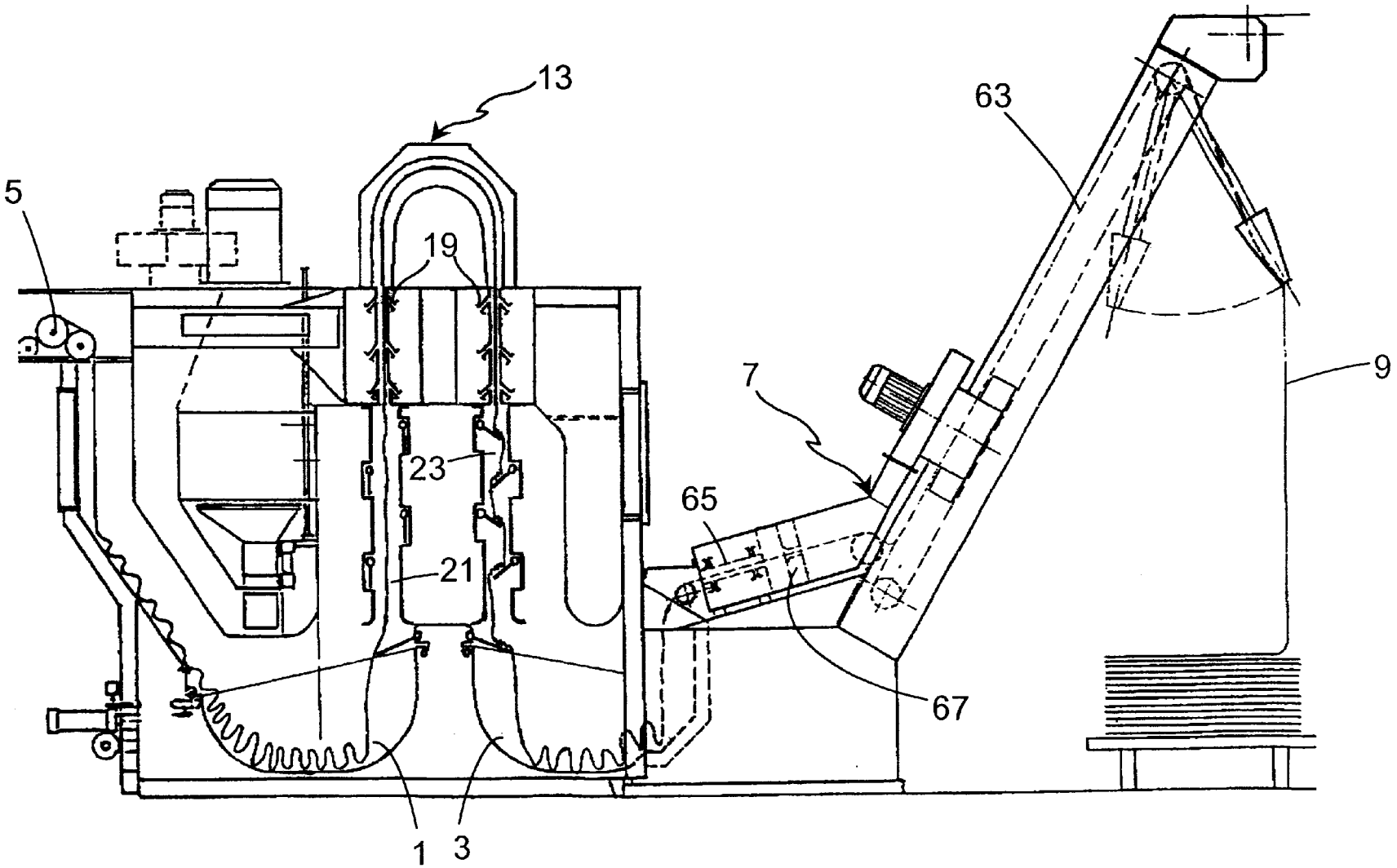
FIG. 12 is a cross section view of an apparatus similar to that of FIG. 1, provided additionally with outlet means having a sloping conveyor belt.

Finally, FIG. 12 shows an apparatus similar to the one shown in FIG. 1, in which the second means 7 includes a conveyor belt 63 which pulls the fabric 9 to the height required without subjecting the fabric 9 to tensile stresses. Before being conveyed by the conveyor belt 63, the fabric 9 passes through a fabric cooling device 65 and through a fabric centering device 67.

What is claimed is:

1. An apparatus for treating fabrics, said apparatus comprising:

a first chamber for forming an infeed side reserve of a fabric;

a second chamber for forming an outfeed side reserve of the fabric;

first means for slowly feeding the fabric into said first chamber;

second means for slowly removing the fabric from said second chamber;

a duct allowing for the passage of said fabric between said first chamber and second chamber;

a fabric transport means capable of forward and reverse operation including nozzles and which is adapted to generate a forward and backward movement of the fabric between said first chamber and said second chamber;

control means for inverting the forward and backward movement; and a collision member adapted to be impacted upon by the fabric, said collision member defining a collision surface adapted to move between a collision position and a free passage position, and said movement between said collision position and said free passage position being synchronized with said forward and backward movement of the fabric.

2. The apparatus of claim 1, further comprising additional collision members each with a collision surface and together with said collision member defining a plurality of collision members grouped together in at least two groups of collision members, wherein in each direction of said forward and backward movement, at least one collision member of each of said two groups of collision members is in a collision position.

3. The apparatus of claim 2, wherein said transport means is situated at an intermediate point of said duct, wherein said movement of the fabric defines a feed direction, which is forward and backward, and wherein said collision members are distributed on both sides of said transport means, wherein only collision members which are downstream of said transport means in said direction of feed of the fabric are in the collision position.

4. The apparatus of claim 1, further comprising additional collision members cooperating with said collision member to defining a plurality of collision members wherein each of said plurality of collision members is at least partly permeable to a fluid.

5. The apparatus of claim 1, further comprising additional collision members each with a collision surface and together with said collision member defining a plurality of collision members comprising flaps with a shaft adapted to rotate about itself and a wall extending lengthwise along said shaft and forming said collision surface.

6. The apparatus of claim 5, wherein said wall comprises a number of hollow tubes having one end attached to said shaft and the other end free.

7. The apparatus of claim 5, wherein said wall comprises a number of solid rods having one end attached to said shaft and the other end free to provide plural free ends.

8. The apparatus of claim 7, wherein said free ends are attached together with another rod.

9. The apparatus of claim 5, wherein said wall comprises a sheet.

10. The apparatus of claim 9, wherein said sheet is provided with orifices.

11. The apparatus of claim 1, further comprising additional collision members each with a collision surface and together with said collision member defining a plurality of collision members with a plurality of collision surfaces wherein said collision surfaces are flat.

12. The apparatus of claim 1, further comprising additional collision members each with a collision surface and together with said collision member defining a plurality of collision members with a plurality of collision surfaces wherein said collision surfaces are concave in the direction of incidence of the fabric.

13. The apparatus of claim 1, further comprising additional collision members each with a collision surface and together with said collision member defining a plurality of collision members with a plurality of collision surfaces wherein said collision surfaces are convex in the direction of incidence of the fabric.

14. The apparatus of claim 1, further comprising additional collision members each with a collision surface and together with said collision member defining a plurality of collision members with a plurality of collision surfaces wherein said plurality of collision members are all identical.

15. The apparatus of claim 1, further comprising additional collision members each with a collision surface and together with said collision member defining a plurality of collision members with a plurality of collision surfaces wherein at least one of said plurality collision members is different from the remaining plurality of collision members.

16. The apparatus of claim 1, further comprising additional collision members each with a collision surface and together with said collision member defining a plurality of collision members with aplurality of collision surfaces moveable between collision positions and free passage positions synchronized with said forward and backward movement of said fabric wherein said collision positions are adjustable.

17. The apparatus of claim 1, further comprising additional collision members each with a collision surface and together with said collision member defining a plurality of collision members with a plurality of collision surfaces moveable between collision positions and free passage positions synchronized with said forward and backward movement of said fabric wherein said collision positions are adjusted jointly for all said plurality of collision members.

18. The apparatus of claim 1, further comprising additional collision members each with a collision surface and together with said collision member defining a plurality of collision members with a plurality of collision surfaces moveable between collision positions and free passage positions synchronized with said forward and backward movement of said fabric wherein at least one of said collision positions is adapted to be adjusted in a different way than the remaining collision positions.

19. The apparatus of claim 1, further comprising additional collision members each with a collision surface and together with said collision member defining a plurality of collision members with a plurality of collision surfaces moveable between collision positions and free passage positions synchronized with said forward and backward movement of said fabric and two adjustable collision members each with a collision position which is adjustable, said adjustable collision members not being subjected to said movement between said collision positions and free passage positions with said plurality of collision members.

20. The apparatus of claim 19, wherein said additional collision members are situated one at each end of said duct.

21. The apparatus of claim 1, wherein the apparatus is used for the dry treatment of fabrics.

22. The apparatus of claim 1, wherein the apparatus is used is for the wet treatment of fabrics.

23. The apparatus of claim 1, wherein the apparatus is used for the treatment of open width fabric webs.

24. The apparatus of claim 1, wherein the apparatus is for the treatment of fabric webs in rope form.

25. The apparatus of claim 1, wherein said second means is provided with a sloping conveyor belt having a bottom end and a top end, said conveyor belt traveling from said bottom end to said top end, the fabric resting on said conveyor belt and said conveyor belt entraining the fabric in said travel, without subjecting the fabric to tensile stresses.

26. The apparatus of claim 1, further comprising hydraulic rams and additional collision members each with a collision surface and together with said collision member defining a plurality of collision members with a plurality of collision surfaces said plurality of collision members being driven by said hydraulic rams.

27. The apparatus of claim 1, further comprising hydraulic rams, a set of levers and additional collision members each with a collision surface and together with said collision member defining a plurality of collision members with a plurality of collision surfaces said plurality of collision members being driven by said hydraulic rams and a set of levers.

28. The apparatus of claim 1, further comprising gears and additional collision members each with a collision surface and together with said collision member defining a plurality of collision members with a plurality of collision surfaces said plurality of collision members being driven by said gears.

29. The apparatus of claim 28, further comprising transmission chains wherein said gears are connected together by said transmission chains.

30. The apparatus of claim 1, further comprising additional collision members each with a collision surface and together with said collision member defining a plurality of collision members with a plurality of collision surfaces wherein at least one of said plurality of collision members is adapted to be operated individually.

31. The apparatus of claim 1, further comprising additional collision members each with a collision surface and together with said collision member defining a plurality of collision members with a plurality of collision surfaces wherein at least one of said collision members is adapted to modify said adjustment of said collision position during said treatment of the fabric.

* * * * *